United States Patent [19]

McCarter, III et al.

[11] 4,298,287

[45] Nov. 3, 1981

[54] CENTER DRAFT ASPHALTIC CONCRETE DRUM MIXER

[75] Inventors: Louis N. McCarter, III, Malvern; W. Robert Deemer, Norristown; Robert G. Meeker, Lansdale, all of Pa.; Harry B. Weaver, Goshen; John W. Smith, Rising Sun, both of Ind.

[73] Assignee: The McCarter Corporation, Norristown, Pa.

[21] Appl. No.: 143,787

[22] Filed: Apr. 25, 1980

[51] Int. Cl.[3] ..... B28C 1/22; B28C 5/00

[52] U.S. Cl. ..... 366/4; 366/12; 366/25

[58] Field of Search ..... 366/2, 4, 5, 7, 10, 366/12, 22–25, 40, 57, 228, 233; 432/106; 34/132

[56] References Cited

U.S. PATENT DOCUMENTS

| | | | |
|---|---|---|---|
| Re. 29,496 | 12/1977 | Dydzyk | 366/25 |
| 3,614,071 | 10/1971 | Brock . | |
| 3,840,215 | 10/1974 | McConnaughay . | |
| 4,147,436 | 4/1979 | Garbelman et al. | 366/25 |

*Primary Examiner*—Philip R. Coe

*Assistant Examiner*—Timothy F. Simone

*Attorney, Agent, or Firm*—Howson and Howson

[57] ABSTRACT

In a continuous drum mix asphalt plant, dust is exhausted from an intermediate zone of the drum mixer between its drying and mixing zones. The dust is exhausted radially through openings into a collection housing, which communicates with a dust collector and exhaust blower. An end housing at the discharge end of the drum communicates with the same dust collector and blower. Dampers are provided to control the relative proportion of air exhausted from the drum through the respective housings. Aggregate deflectors on the interior wall of the drum at the intermediate zone allow air and dust to flow while inhibiting the flow of aggregate. The collection housing surrounding the intermediate zone is of a size such as to produce a reduction in the velocity of the air as it passes out of the drum. Consequently, it serves as a knock-out box for the collection of larger particles which are carried out of the drum, but which settle out of the air stream as a result of the velocity decrease. These collected particles are reintroduced into the drum by scoops on the exterior of the drum. These scoops are also used for the introduction of recycled asphaltic concrete.

11 Claims, 3 Drawing Figures

CENTER DRAFT ASPHALTIC CONCRETE DRUM MIXER

BACKGROUND OF THE INVENTION

This invention relates to the preparation of paving materials, and specifically to an improved method and apparatus for preparing asphaltic concrete.

One method of preparing asphaltic concrete is to mix aggregate (e.g. limestone, gravel, granite, trap rock or similar materials) and liquid asphalt in a device known as a "drum mixer". A typical drum mixer comprises an elongated, hollow cylindrical, steel drum, the longitudinal axis of which is disposed at an inclination of approximately three degrees to six degrees with respect to the horizontal. The drum is supported for rotation about its longitudinal axis on rollers, and gear or chain drive means are provided to effect rotation. Aggregate in the desired size gradation is introduced into the upper end of the drum, and is slowly carried to the opposite end as a result of drum rotation. Flights are provided within the drum to lift the aggregate as the drum rotates, and to cause the aggregate to fall in a continuous shower across the drum's cross-section.

Air is drawn through the drum from the upper to the lower end, and passes out of the lower end through a stationary housing, and thence into a dust collector (typically a bag house) which has an exhauster at its downstream side.

A burner, located at the upper end of the drum, projects a flame into the drum which heats the air passing through the drum. The hot air removes moisture as it encounters the showering aggregate as it passes through the hot upper or drying section. Hot liquid asphalt is introduced into the drum through a supply pipe, having an outlet at an intermediate location in the drum, causing mixing in the lower and cooler section. Preferably a suitable shielding device is provided which shields the outlet of the asphalt supply pipe from the flame of the burner while allowing the dried aggregate to pass to a location where it can become mixed with the asphalt. As the drum rotates, the dried aggregate becomes mixed with the liquid asphalt to produce an asphaltic concrete product. The product is discharged from the lower or discharge end of the drum. The hot air flowing through the drum supplies heat to the mixture in the drum so that the product is discharged at the desired temperature, which is typically between about 270° and 280° F.

As the aggregate moves through the drying zone of the drum, dust is produced which is picked up by the air flowing through the drum. Some of the dust produced in the drying zone is captured by the asphalt being showered from the outlet of the asphalt supply pipe onto the aggregate in the mixing zone. The remaining dust which is not captured in the mixing zone is collected in the dust collector.

The capture of moderate quantities of fine dust by the liquid asphalt in the mixing zone is beneficial, since the fine dust serves as a filler, and since the capture of fine dust reduces the dust collection requirements. In certain localities, however, and notably in Kentucky and Tennessee, the available aggregates tend to produce excessive quantities of dust. If these aggregates are mixed with asphalt in a conventional drum mix plant, the product frequently fails to meet the gradation specifications for the final mix. Accordingly, where excessive dust conditions are encountered, instead of using a drum mixer, the usual practice has been to prepare asphaltic concrete by using a batch process in which drying of the aggregate is carried out in a separate drying drum, and mixing of the dried aggregate with asphalt takes place in a pug mill at a separate location. The bath process is well recognized as more expensive than the continuous drum mix process.

Several types of drying drums, for use in the batch process, are known in the art. The most popular drying drum is the conventional counterflow dryer in which aggregate and air flow through the drum in opposite directions. Dust is carried with air from the air outlet end to a dust collector. A burner is located at the aggregate outlet end (and air inlet end) and projects a flame into the drum in order to effect drying.

The conventional counterflow dryer is somewhat inefficient because of the fact that the aggregate, as it enters the drum, first encounters cool moist air leaving the drum, and only thereafter encounters warm dry air.

A parallel flow dryer, having the burner situated at the aggregate inlet/air inlet end overcomes this problem but presents aggregate temperature control problems that make it unpopular.

In order to meet the problem of inefficiency in the conventional counterflow dryer, and at the same time avoid the temperature control problem which would arise if the burner were remote from the aggregate outlet, a center draft dryer has been used. The center draft dryer comprises a drum having burners at both ends, and openings at a central location in communication with a collection housing through which air is drawn and carried to a dust collector. Air enters the center outlet dryer through both ends, and travels toward the center outlet where it is withdrawn along with dust. Aggregate travels from one end of the dryer to the other. At the side of the center outlet at which aggregate is introduced, aggregate and air move in the same direction. In this section, the differences between the temperatures and moisture contents of the air and aggregate are such as to promote efficient drying. The burner at the end of the dryer at which aggregate is withdrawn effects further drying of the aggregate, and also provides for better control of the temperature of the aggregare leaving the dryer.

It is also known to provide central openings in a mixing drum for the purpose of introducing used asphalt pavement for recycling.

Despite the fact that these two devices having central openings have been well known in the art for a long period of time, no one has recognized heretofore that the provision of central openings in a drum mixer can be used to provide a solution to the dust problem which has been throught to require use of a separte dryer and mixer.

BRIEF SUMMARY OF THE INVENTION

In accordance with this invention, air is drawn from an intermediate zone in a rotating drum mixer between the drying and mixing zones. Suspended dust particles and moisture are carried out of the drum with the air before they reach the mixing zone, and are thereby isolated from the asphalt and aggregate in the mixing zone.

In the preferred embodiment of the invention, air and suspended particles are drawn out of the drum through openings in the wall of the drum into a collection housing. In accordance with the invention, the collection housing can be used to collect larger particles, and these larger particles can be returned to the interior of the drum by means of scoops built into the drum wall. The openings in the drum wall may also be used for introducing used asphaltic concrete for recycling.

Another feature of the invention involves the provision of a common dust receiving air from the intermediate outlet openins of the drum, and also receiving air from the discharge end of the drum, together with damper means for regulating the relative flow through the respective air outlets in order to control the flow of dust, and also to control the temperature in the mixing zone.

The principal object of this invention is to provide an improved drum mixer in which a high quality asphaltic concrete can be produced using an aggregate having a high dust content.

A further object of the invention is the provision of novel means by which the quantity of dust introduced into the mixing section of a drum mixer can be controlled.

Still other objects of the invention will be apparent from the following detailed description when read in conjunction with the drawings.

DETAILED DESCRIPTION

Figure 1:
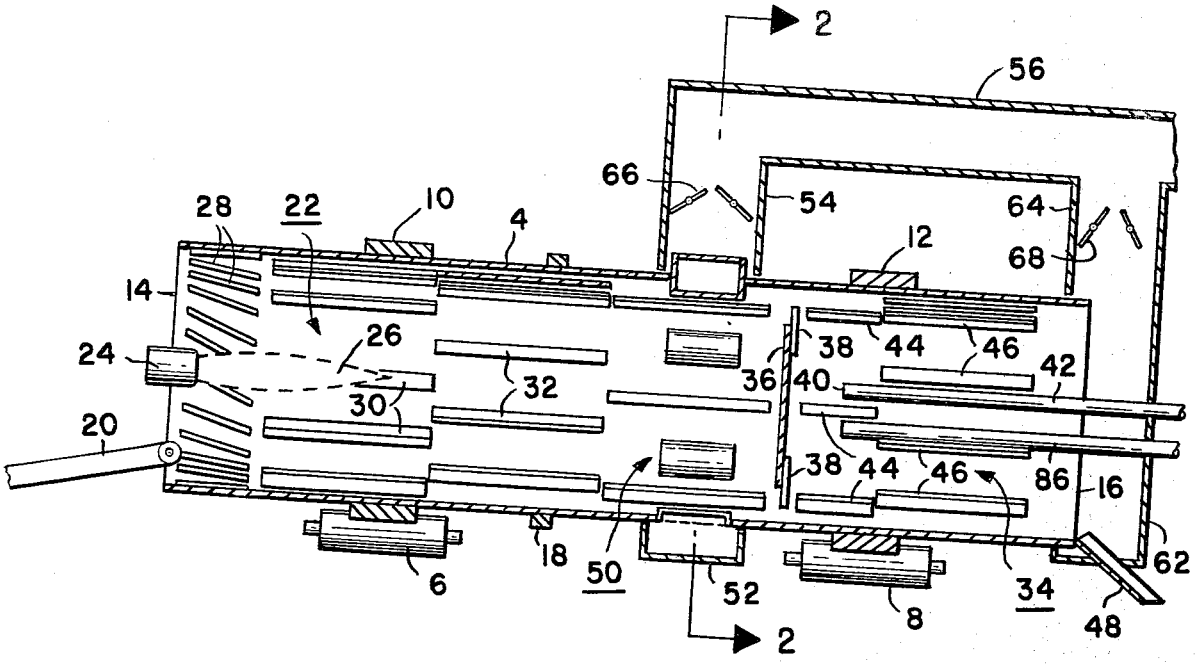
FIG. 1 is an axial section of a drum mixer in accordance with the invention.

As shown in FIG. 1, a cylindrical steel drum 4 is supported for rotation about its longitudinal axis on a set of four rollers, two of which are shown at 6 and 8. The drum is provided with a pair of steel tires 10 and 12 which ride on the rollers.

The drum axis is inclined at an angle between about three degrees and about six degrees with resect to horizontal so that its inlet end 14 is higher than its discharge end 16. The drum is rotated about its longitudinal axis by a suitable drive motor (not shown) having a pinion in mesh with gear 18 on the outside of the drum.

Aggregate is introduced into the drum through inlet end 14 by means of a slinger 20 or alternatively by a gravity chute or other suitable means. Extending inwardly from the inlet end is a drying zone generally indicated at 22. A burner 24 projects a flame 26 into drying zone 22. Helical flights 28, near inlet end 14 serve to insure that aggregate entering the drum moves toward the outlet end. Within drying zone 22 sets 30 and 32 of flights are provided for lifting aggregate material, and releasing the material downwardly through the area heated by flame 26 for the removal of moisture from the aggregate.

Because of the inclination of the drum, and the lifting action of the flights, aggregte moves through zone 22 toward a mixing zone 34, which extends inwardly from discharge end 16. The inner boundary of mixing zone 34 is defined by a flame shield 36 which prevents the heat of the flame from acting directly on the material within zone 34. Shield 36 is preferably in the form of a circular plate, mounted by brackets 38 extending from the interior wall of the drum so that an annular space is provided at the periphery of shield 36 allowing for the passage of aggregate into mixing zone 34. Hot liquid asphalt is introduced into the mixing zone through opening 40 of asphalt pipe 42. Mixing zone 34 has two sets of flights 44 and 46 which serve to effect mixing of the aggregte and asphalt in the mixing zone. The product is discharged over a chute 48.

Figure 3:
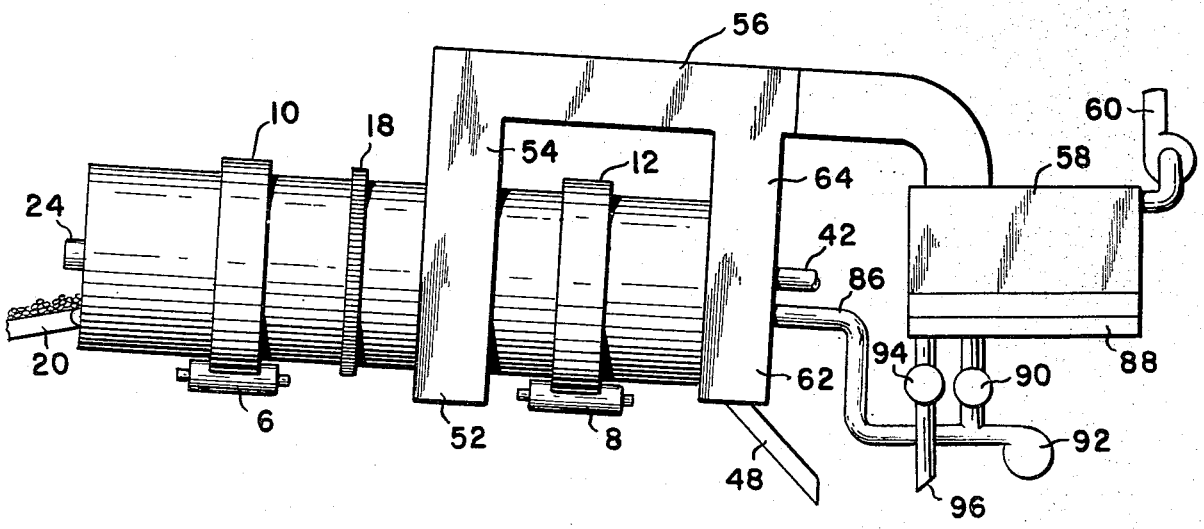
FIG. 3 is a partial schematic view of a continuous drum mix asphalt plant using a drum mixer in accordance with the invention.

Before passing underneath shield 36 into zone 34, aggregate from the drying zone passes through an intermediate third zone 50, which is surrounded by a stationary collection housing 52 the upper end of which is connected through a duct 54, and duct 56 to a bag house 58 (FIG. 3) having an exhaust blower 60 at its downstream side. A series of openings is provided in the wall of the drum 4 at zone 50 allowing air and suspended particles to be drawn out of zone 50 and through ducts 54 and 56 to bag house 58.

A stationary end housing 62 at dischrge end 16 of the drum is connected through duct 64 to duct 56, so that air and any remaining suspended particles can be drawn into bag house 58 from outlet end 16 of the drum and air flow can be maintained through the mixing zone 34 to control temperature.

As shown in FIG. 1, duct 54 is provided with damper 66, and duct 64 is provided with damper 68. These dampers may be independently adjustable or slaved together, depending on the application.

Figure 2:
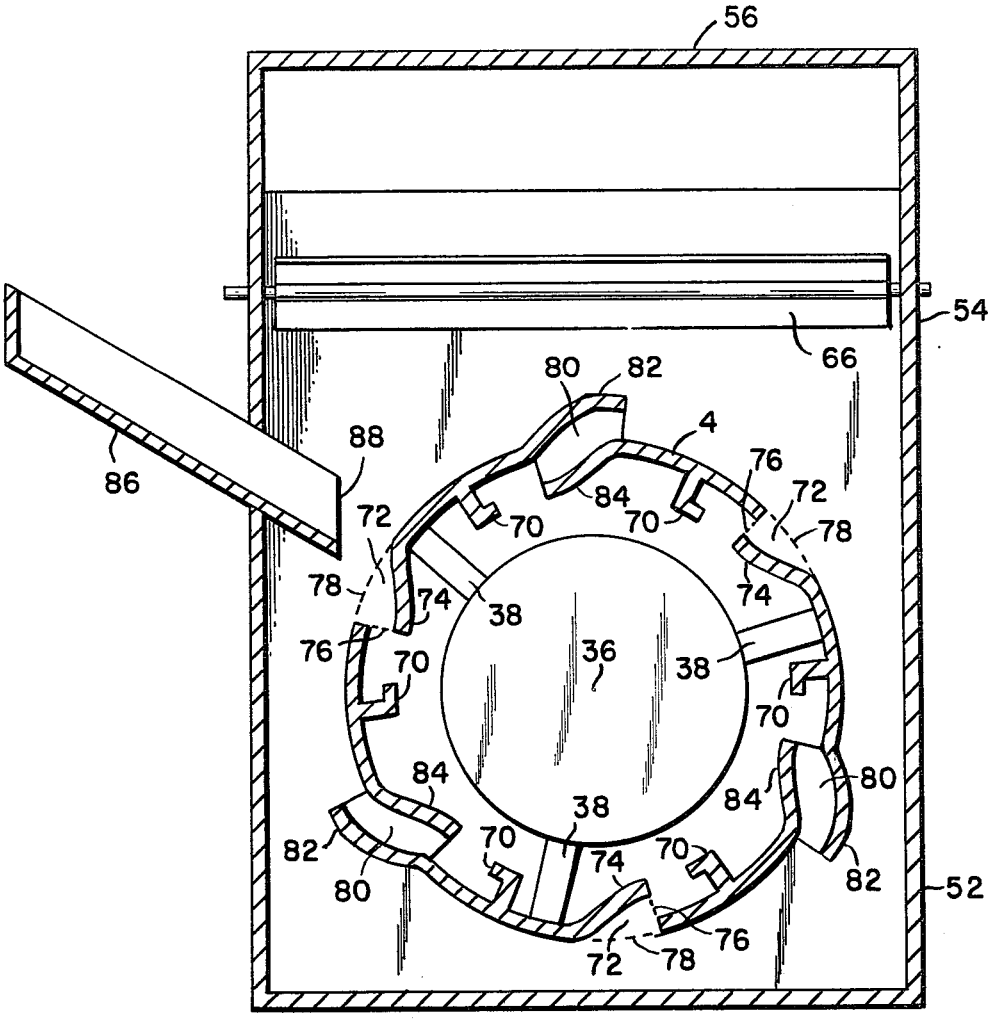
FIG. 2 is a section taken on the plane 2—2 of FIG. 1.

FIG. 2 shows the details of section 50 of the interior of the drum. Flights are provided at 70 for lifting aggregte, and dropping it through the cross-sectional area with zone 54 for transporting the material through the intermediate zone 50 and for further drying under the heat of the burner. A first series of opening 72 is provided primarily for the release of air and suspended particles into collection housing 52. Openings 72 are provided with baffles 74 which extend inwardly from the wall and also in a direction opposite to the direction of rotation of the drum (which is clockwise as viewed in FIG. 2). Preferably, wire mesh screens 76 and 78 are also provided at each opening 72. Screens 78 extend circumferentially from the leading to the trailing edges of openings 72, and screens 76 extend substantially from the trailing edges of the openings to the ends of baffles 74 which are located farthest in the direction opposite to the direction of drum rotation. Baffles 74 serves as deflectors to prevent aggregate falling from flights 70 from clogging the screens. They also prevent some of the aggregate particles of intermediate size from passing through the screens. Smaller airborne particles, however pass freely through the screens and openings 72 into collection housing 52.

Additional openings are provided at 80 which serve primarily to return aggregate particles from collection housing 52 to the interior of the drum so that they are moved into mixing zone 34 from zone 50. To this end, openings 80 are provided with scoops 82 which extend outwardly from the wall of drum 4, and also circumferentially in the direction of rotation. Openings 80 are also provided with deflection baffles 84, which are similar in construction to baffles 74. Baffles 84 deflect aggregte falling from the flights, and prevent most of the aggregate from dropping out of the drum through openings 80.

The size of collection housing 52 is sufficiently large in comparison to the diameter of the drum to produce a significant decrease in the velocity of the air as it leaves the drum through the openings of zone 50. The decrease in velocity causes larger particles to drop out of the air stream, while undesirable smaller particles stay airborne, and pass upwardly through duct 54 into duct 56. Collection housing 52 consequently serves as a "knock-out" box, collecting all dust particles which drop out of the drum and which are not carried by the air stream into ducts 54 and 56. The collected dust particles are returned to the drum interior by scoops 82.

A chute 86 is provided with its end 88 positioned in relation to the wall of drum 4 so that it can be used to deliver used asphaltic concrete into the interior of the drum at zone 50 through openings 80 with the aid of scoops 82. The location at which used asphalt-aggregte composition is returned to the drum is desirably adjacent flame shield 36 so that the time of direct exposure of the used composition to the burner flame is short. For still further protection of the used asphalt-aggregate composition from direct exposure to the heat of the flame, the flame shield can be positioned on the upstream side of zone 50.

Screens 78, which are located substantially in the cylinder of the drum wall prevent the used asphalt-aggregate composition being delivered by chute 86 from entering openings 72 and accumulating in the pockets formed by screens 76 and baffles 74. Screens 76, in turn, prevent aggregate from the interior of the drum from accumulating in the pockets formed by baffles 74 and screens 78. For these reasons, it is particularly advantgeous to use both sets of screens.

Openings 80 serve three purpooses. First, they serve along with openings 72 to allow air and suspended particles to pass from zone 50 within the drum into the interior of collection housing 52. Second, they allow for the reentry of settled particles from collection housing 52 into zone 50. Third, they provide for the recycling of used asphaltic concrete into the drum.

Referring again to FIGS. 2 and 3, a pipe 86 is provided for the return of dust from the bag house to the mixing zone of the drum mixer. Dust is returned from the bag house through this pipe whenever needed for control of the quantity of dust in the product. Dust is delivered from bag house 58 through auger 88, and rotary valve 90 to pipe 86, through which it is transported into the mixing zone by a blower 92. An additional rotary valve 94 is provided to carry dust collected in the bag house to dust outlet 96.

The apparatus described above can be used for the preparation of asphaltic concrete from a wide variety of aggregate compositions. Where the aggregtre is such that only moderate quantities of dust are produced in the drying zone, damper 66 can be closed, so that substantially all of the air entering the drum through inlet end 14 is drawn through discharge end 16 and through ducts 64 and 56 to bag house 58. A portion of the dust carried by the air flow past flame shield 36 is captured by the hot liquid asphalt-coated stone. Any additional dust particles needed to achieve the desired product composition are delivered into mixing zone 34 through pipe 86. The rate at which dust is delivered through pipe 86 can be controlled by controling the speed of operation of rotary valve 90.

Where the aggregate is such that larger quantities of dust are produced in the drying zone, damper 66 is either partially or fully opened so that at least part of the dust produced in drying zone 22 is drawn out of zone 50 through duct 54 and is carried to bag house 58 through dust 56. Damper 68 may be partially closed when necessary in order to enhance the flow of air and dust out of zone 50 through duct 54. Damper 68 will not normally be closed altogether, however, as the complete elimination of air flow in mixing zone 34 would result in a decrease in product temperature which would prevent the product delivered over chute 48 from flowing properly and from satisfying the required mix temperature specification. In normal operation of the apparatus, the degrees to which dampers 66 and 68 are opened are coordinated in such a way as to isolate a sufficient amount of excess dust produced in the drying zone from the asphalt and aggregate in the mixing zone, while at the same time maintaining an adequate temperature in the mixing zone to maintain flowability of the product delivered at the discharge end of the drum. Preferably,, the dampers are adjusted to achieve an optimum product discharge temperature, and at the same time to pass either an optimum or slightly less than optimum amount of dust around flame shield 36. Any additional dust required is made up through dust pipe 86.

We claim:

1. A method of preparing asphaltic concrete comprising introducing aggregate into a rotating drum, exposing the aggregate to heat in a first zone of said drum to effect drying of the aggregate while in said first zone, causing the aggregate to move to a second zone of the drum, introducing asphalt into the second zone of the drum, mixing the aggregate with asphalt in the second zone, and drawing air axially through said drum in the direction from said first zone toward said second zone, and characterized by the steps of drawing air from a third zone in said drum located between said first and second zones, drawing suspended particles produced in the drying step out of said drum along with the air drawn from said third zone, and at least temporarily isolating the suspended particles and air drawn out of said drum from said third zone from the asphalt and aggregate in said second zone.

2. The method of claim 1 in which the steps of drawing air and suspended particles from a third zone are carried out by passing air and suspended particles from said third zone radially outwardly through openings in the wall of the drum into a collection housing surrounding said third zone of the drum.

3. The method of claim 1 in which the steps of drawing air and suspended particles from a third zone are carried out by passing air and suspended particles from said third zone radially outwardly through openings in the wall of the drum into a collection housing surrounding said third zone of the drum, and including the steps of causing the velocity of flow of air and suspended particles to be reduced within said collection housing, thereby causing larger particles to settle in said collection housing, and returning at least part of the settled larger particles to the second zone of the drum.

4. The method of claim 1 in which the steps of drawing air and suspended particles from a third zone are carried out by passing air and suspended particles from said third zone radially outwardly through openings in the wall of the drum into a collection housing surrounding said third zone of the drum, and including the steps of causing the velocity of flow of air and suspended particles to be reduced within said collection housing, thereby causing larger particles to settle in said collection housing, and returning at least part of the settled larger particles to the second zone of the drum by scooping them out of said collection housing.

5. The method of claim 1 in which the steps of drawing air and suspended particles from a third zone are carried out by passing air and suspended particles from said third zone radially outwardly through openings in the wall of the drum into a collection housing surrounding said third zone of the drum, and including the step of introducing used asphaltic concrete into said third zone, simultaneously with the step of drawing air and suspended particles from said third zone, by passing said used asphaltic concrete radially inwardly through said openings in the wall of the drum at the location of said third zone.

6. Apparatus for making asphaltic concrete comprising a hollow drum, having an inlet end and a discharge end, means for rotating the drum about its longitudinal axis, the drum having a drying zone extending inwardly from the inlet end, a mixing zone extending inwardly from the discharge end and a third zone located between the drying and mixing zones, burner means for directing a flame into the drying zone, means for lifting aggregate material in the drying zone and dropping the material so lifted downwardly through the area heated by the flame for removal of moisture, means for introducing asphalt into the mixing zone, means for effecting flow of dried aggregate from the drying zone to the mixing zone, means for effecting mixing of the aggregate and asphalt in the mixing zone, means for drawing air axially through the drum in the direction from the drying zone to the mixing zone, means for drawing air and suspended particles produced in the drying zone out of the drum from the third zone, and for at least temporarily isolating the suspended particles and air drawn out of the third zone from the asphalt and aggregate in the mixing zone.

7. Apparatus according to claim 6 in which the means for drawing air and suspended particles out of the drum from the third zone comprises a collection housing surrounding the third zone, and a series of openings in the wall of the drum at the location of the third zone, said openings providing for flow of air and suspended particles from the interior of the drum outwardly into the collection housing.

8. Apparatus according to claim 6 in which the means for drawing air and suspended particles out of the drum from the third zone comprises a collection housing surrounding the third zone, and a series of openings in the wall of the drum at the location of the third zone, said openings providing for flow of air and suspended particles from the interior of the drum outwardly into the collection housing, in which said means for drawing air axially through the drum comprises a second housing located at said discharge end and communicating with said mixing zone, said apparatus including blower means and dust collector means connected to said blower means, said blower means being arranged to draw a vacuum or both said collection housing and said second housing, and adjustable damper means for regulating the relative flow through the collection housing and the second housing.

9. Apparatus according to claim 6 in which the means for drawing air and suspended particles out of the drum from the third zone comprises a collection housing surrounding the third zone, and a series of openings in the wall of the drum at the location of the third zone, said openings providing for flow of air and suspended particles from the interior of the drum outwardly into the collection housing, said collection housing being of a size in comparison with the size of the drum at the location of the third zone that the rate of flow within the collection housing is lower than that through said openings, whereby larger suspended particles tend to settle in the collection housing, and having scoop means fixed to the exterior of the drum for returning particles from the collection housing to the interior of the drum.

10. Apparatus according to claim 6 in which the means for drawing air and suspended particles out of the drum from the third zone comprises a collection housing surrounding the third zone, and a series of openings in the wall of the drum at the location of the third zone, said openings providing for flow of air and suspended particles from the interior of the drum outwardly into the collection housing, each opening of said series having deflection baffle means for reducing the loss of aggregate from the interior of the drum while allowing air and suspended particles to flow freely out of the drum to the collection housing.

11. Apparatus according to claim 6 in which the means for drawing air and suspended particles out of the drum from the third zone comprises a collection housing surrounding the third zone, and a series of openings in the wall of the drum at the location of the third zone, at least one of said openings having deflection baffle means extending inwardly from the wall and also in a direction opposite to the direction of drum rotation for reducing the loss of aggregate from the interior of the drum while allowing air and suspended particles to flow freely out of the drum to the collection housing, first screen means extending circumferentially from one edge of said one of said openings to the other, and second screen means extending substantially from the end of the deflection baffle means which is located farthest in the direction opposite the direction of drum rotation to the trailing edge of said one of said openings with reference to the direction of drum rotation, and having means for delivering used asphalt-aggregate composition to the exterior of drum at the location of the third zone and within said collection housing, said series of openings including means providing at least one other opening for permitting used asphalt-aggregate composition from said delivering means to pass into the interior of said drum at the location of said third zone.

* * * * *

UNITED STATES PATENT AND TRADEMARK OFFICE

CERTIFICATE OF CORRECTION

PATENT NO. : 4,298,287

DATED : November 3, 1981

INVENTOR(S) : McCarter et al.

It is certified that error appears in the above-identified patent and that said Letters Patent are hereby corrected as shown below:

Column 2, line 5, "bath" should be --batch--

Column 2, line 35, "center" should be --central--

Column 2, line 45, "aggregare" should be --aggregate--

Column 2, line 54, "throught" should be --thought--

Column 2, line 54, "separte" should be --separate--

Column 3, line 7, "dust" should be --duct--

Column 3, line 8, "openins" should be --openings--

Column 3, line 42, "resect" should be --respect--

Column 3, line 60, "aggregte" should be --aggregate--

Column 4, line 5, "aggregte" should be --aggregate--

Column 4, lines 28-29, "aggregte" should be --aggregate--

Column 4, line 32, "opening" should be --openings--

Column 4, line 44, "serves" should be --serve--

UNITED STATES PATENT AND TRADEMARK OFFICE

CERTIFICATE OF CORRECTION

PATENT NO. : 4,298,287

DATED : November 3, 1981

INVENTOR(S) : McCarter et al.

It is certified that error appears in the above-identified patent and that said Letters Patent are hereby corrected as shown below:

Column 4, line 59, "aggregte" should be --aggregate--

Column 5, line 11, "aggregte" should be --aggregate--

Column 5, lines 26-27, "advantgeous" should be --advantageous--

Column 5, line 47, "aggregtre" should be --aggregate--

Column 5, line 58, "controling" should be --controlling--

Column 6, line 12, delete the second occurrence of ","

Signed and Sealed this

Ninth Day of February 1982

[SEAL]

Attest:

GERALD J. MOSSINGHOFF

Attesting Officer

Commissioner of Patents and Trademarks